US005159393A

United States Patent [19]

Hiroshima et al.

[11] Patent Number: 5,159,393

[45] Date of Patent: Oct. 27, 1992

[54] IMAGE FORMING APPARATUS HAVING TRANSFER DEVICE AND IMAGE BEARING MEMBER TRAVELING AT DIFFERENT SPEEDS

[75] Inventors: Koichi Hiroshima, Yokohama; Yukihiro Ohzeki, Kashiwa; Junji Araya, Yokohama; Yasushi Sato, Kawasaki; Tatsunori Ishiyama, Yokohama; Kimio Nakahata, Kawasaki; Koichi Tanigawa, Tokyo; Akihiko Takeuchi, Yokohama; Takayasu Yuminamochi, Yokohama; Yoshiro Tsuchiya, Yokohama, all of Japan

[73] Assignee: Canon Kabushiki Kaisha, Tokyo, Japan

[21] Appl. No.: 561,075

[22] Filed: Aug. 1, 1990

[30] Foreign Application Priority Data

Aug. 2, 1989 [JP] Japan ..... 1-199333
Nov. 6, 1989 [JP] Japan ..... 1-288171

[51] Int. Cl.[5] ..... G03G 15/14

[52] U.S. Cl. ..... 355/277; 355/271

[58] Field of Search ..... 355/271, 274, 275, 276, 355/277, 281, 279, 317, 217, 295, 282, 290

[56] References Cited

U.S. PATENT DOCUMENTS 4,066,352 1/1978 Kameda et al. ..... 355/217
4,380,385 4/1983 Osaki et al. ..... 355/277
4,674,860 6/1987 Tokunaga et al. ..... 355/274
4,894,687 1/1990 Beaudet ..... 355/277

FOREIGN PATENT DOCUMENTS 0074677 3/1983 European Pat. Off. ..... 355/271
0297911 1/1989 European Pat. Off. ..... 355/274
0313363 4/1989 European Pat. Off. ..... 355/271
0077533 7/1978 Japan ..... 355/277
56-126872 10/1981 Japan .
0032070 2/1986 Japan ..... 355/271
1271606 4/1972 United Kingdom .

*Primary Examiner*—A. T. Grimley
*Assistant Examiner*—William J. Royer
*Attorney, Agent, or Firm*—Fitzpatrick, Cella Harper & Scinto

[57] ABSTRACT

An image forming apparatus includes a movable image bearing member, an image forming device for forming the image bearing member, and an image transfer device contactable to the image bearing member at an image transfer position. The transfer device transfers the image formed by the image forming device onto a transfer material while the transfer material is conveyed through the transfer position together with the image bearing member, wherein the transfer device has a hardness of 20–40 degrees (Asker-C), and it is pressed to the image bearing member at a pressure of 50–200 g/cm$^2$, and wherein a peripheral speed of the transfer device at the transfer position during a transfer operation is higher than a peripheral speed of the image bearing member at the transfer position.

30 Claims, 4 Drawing Sheets

$$\begin{cases} V_P < V_{Tr} \\ V_P < V_{Reg} \end{cases}$$

IMAGE FORMING APPARATUS HAVING TRANSFER DEVICE AND IMAGE BEARING MEMBER TRAVELING AT DIFFERENT SPEEDS

FIELD OF THE INVENTION AND RELATED ART

The present invention relates to an image forming apparatus such as a copying machine, a printer, a microfilm reader-printer or a display machine of an image transfer type using an electrophotographic method, electrostatic method or a magnetic recording method. And more particularly to an image transfer device for transferring a transferable image (visualized image) formed on a first image bearing member such as an electrophotographic photosensitive member, an electrostatic recording dielectric member or a magnetic recording magnetic member onto a transfer material (second image bearing member).

Referring first to FIG. 6, one type of an image transfer device 104 for an image forming apparatus is shown wherein a roller type image transfer means 101 to which a voltage is applied is contacted to an image bearing member 100. A visualized image formed on the image bearing member 100 with toner or the like reaches to a contact portion 102 between the image bearing member 100 and the transfer means 101 (transfer position), by rotation of the image bearing member 100 in a direction indicated by an arrow. Then, the image is transferred onto a transfer material 103 which is supplied to the transfer position in timed relation with the image on the image bearing member. The roller type image transfer means is advantageous over the image transfer device using an image transfer corona discharger in that the transfer material is conveyed in good order and that the ozone production is small and a low voltage source is usable.

It has been found, however, that the transfer material 103 can not follow the rotating speed of the image bearing member with the result of improper image transfer having, for example, a central void.

Japanese Laid-Open Patent Application No. 126872/1981 proposes, for the purpose of providing a solution to the above problem, as follows. The transfer means is in the form of an elastic roller to which a voltage is applied. In consideration of the hardness of the roller, and the pressure of the contact to the image bearing member, the peripheral speeds of the roller and the image bearing member at the contact portion therebetween are made equal to each other. More particularly, the peripheral speed of the roller at the periphery is higher than the peripheral speed of the image bearing member, in consideration of the deformation of the roller (smaller radius).

However, even if the peripheral speeds of the image bearing member and the roller are made equal at the contact portion, there still remains the problem because of the slippage or positional deviation between the transfer material and the image bearing member at the contact portion attributable to the variations in the material or friction coefficient or the like of the transfer material.

In this type of the transfer device, the transfer roller 101 presses the visualized image toner to the image bearing member 100 as well as to the transfer material 103 when the visualized image is transferred from the image bearing member to the transfer material 103. Therefore, the transferred image may have so-called "central void", that is, the central portion having little or no toner, as indicated by reference *7b* in FIG. 7B, as contrasted to the proper transfer image *7a* shown in FIG. 7A.

The central void of the transferred image more frequently occurs when the transfer material 103 is a transparent film (OHP film or sheet) for use with an overhead projector.

SUMMARY OF THE INVENTION

Accordingly, it is a principal object of the present invention to provide an image forming apparatus wherein the image can be transferred without the central void.

It is another object of the present invention to provide an image forming apparatus wherein the central void of the transferred image can be avoided irrespective of the material of the transfer sheet.

It is a further object of the present invention to provide an image forming apparatus wherein the image can be transferred onto the transfer sheet without deviation.

It is a further object of the present invention to provide an image forming apparatus wherein the transfer material conveyance is improved at the image transfer station, so that good images can be formed.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
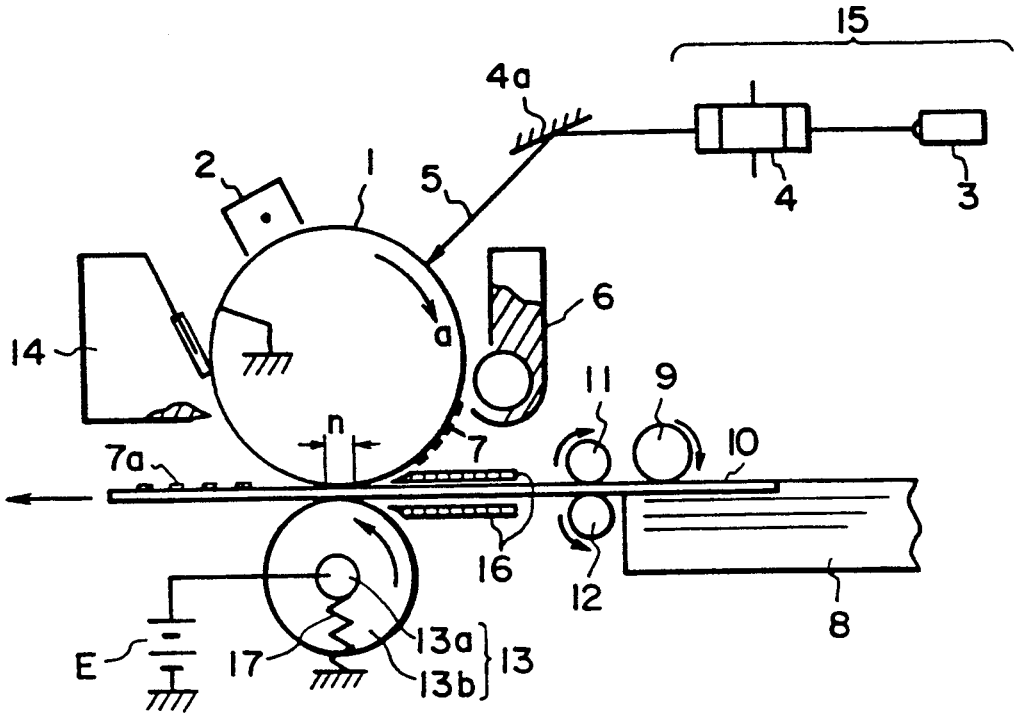
FIG. 1 is a sectional view of an image forming apparatus according to an embodiment of the present invention.

Referring now to FIG. 1, there is shown an image forming apparatus according to an embodiment of the present invention. The exemplary image forming apparatus is a laser beam printer using an image transfer type electrophotographic process. The image forming apparatus comprises an electrophotographic photosensitive member in the form of a rotatable drum (photosensitive drum) functioning as the first image bearing member. The photosensitive drum 1 rotates in the clockwise direction (arrow a) at a predetermined peripheral speed (process speed).

The outer periphery of the photosensitive drum 1 being rotated is uniformly charged to a predetermined polarity by a primary corona charger 2.

The charged surface of the photosensitive drum 1 is then exposed to laser beam 5 which is modulated in accordance with image information (time series electric digital signals) from a host device such as an image reader, computer or word processor. The laser beam 5 is projected by a laser beam scanner 15. The electric charge on the drum is attenuated at the positions where the laser beam is projected, so that an electrostatic latent image is gradually formed (the information is written).

The laser beam scanner 15 includes a laser source 3, a polygonal mirror 4 and a reflection mirror 4*a*. The polygonal mirror 4 rotates at a predetermined rotational speed corresponding to the peripheral speed of the photosensitive drum 1, and the laser source 3 is turned on and off at predetermined intervals (which will hereinafter be called "image clock"), so as to provide a predetermined image resolution. The unit of the image resolution is expressed by the number of unit picture elements per inch (DPI, dot per inch), for example, and the resolution will be expressed as "300 DPI", which corresponds to 12 per mm (=300/25.4).

The electrostatic latent image thus formed is developed into a visualized image 7 by the developing device 6 with developer particles containing toner.

Transfer materials 10 (the second image bearing member) are accommodated in a cassette 8. The topmost transfer material 10 is singled out by a pickup roller 9. It is then fed to an image transfer nip position n in timed relation with the visualized image 7 (transferable image) on the photosensitive drum 1, that is, in timed relation with the rotational angle of the photosensitive drum 1, through a conveyance passage 16 by a pair of registration rollers 11 and 12. The transfer nip position, that is, the transfer position n is constituted by the pressure-contact between the photosensitive drum 1 and the transfer member (roller) 13. The visualized image 7 is transferred from the photosensitive drum 1 to the transfer material 10 sequentially, so that a transferred image 7*a* is produced.

The transfer material 10 now having the transferred image is advanced to an unshown image fixing device. The surface of the photosensitive drum 1 from which the image has been transferred is cleaned by a cleaner 14, by which the residual toner or the like is removed, and therefore, is prepared for the next image formation.

The transfer member 13 generally is in the form of a rotatable roller (transfer roller) comprising a core metal 13*a* coated with an electrically conductive elastic layer 13*b*. The transfer roller 13 is urged toward the photosensitive drum 1 by urging means 17 such as a spring acting on the core metal 13*a* adjacent the opposite longitudinal ends thereof. By doing so, the transfer roller 13 is urged by a predetermined pressure and is rotated in a counterclockwise direction (arrow b) codirectionally with the rotation of the photosensitive drum 1. A predetermined bias voltage is applied from the electric voltage source E.

The visualized image is sequentially transferred onto the surface of the transfer material 10 at the transfer nip position n by cooperation of the pressure-contact of the transfer material 10 by the photosensitive drum 1 and the transfer roller 13. A DC bias voltage having a polarity opposite to that of the toner is applied to the transfer roller 13 from the voltage source E.

In place of the primary corona charger 2, a charging roller contactable to the photosensitive drum 1 is usable.

In this case, it is preferable that the voltage source E for applying the voltage to the transfer roller 13 is used also as a voltage source for the charging roller.

The description will be made as to the transfer roller 13 itself. The material thereof was foaming EPDM rubber having a hardness of 28 degrees (Asker C), the rubber containing dispersed conductive ZnO for providing the electric conductivity.

Examples of another material for the transfer roller 13 is CR rubber, NBR, urethane rubber, Si rubber and fluorinated rubber.

The hardness of the transfer roller is preferably 20–40 degrees (Asker C). In order to accomplish image transfer uniformly along the length of the transfer roller, it is desirable that the electric field in the transfer nip n is uniform. If the hardness of the transfer roller is less than 20 degrees (sponge roller) the pressure of the contact between the photosensitive drum and the roller has to be reduced to prevent the openings of the roller from being closed, in order to provide the uniform electric field, since such a roller has a high forming rate. Then, the conveying performance thereof for the transfer material decreases. As a result, the transfer material slips at the transfer nip, so that the resultant image is blurred. On the other hand, in order to assure sufficient transfer nip with a roller having a hardness exceeding 40 degrees, the pressure has to be increased. Then, the transfer roller presses the toner particles with strong force to the photosensitive drum by way of the transfer material P, with the result of very high liability of the central void.

Other examples of the conductive materials dispersed in the transfer roller 13 for the purpose of giving the conductive property, include carbon or metal filler such as ZnO or $SnO_2$. However, metal filler is preferable since the specific resistivity is relatively high, and therefore, is not easily influenced by change in the ambient conditions, and since the conductivity can be easily controlled by controlling the content thereof. Particularly ZnO is further preferable.

Figure 2A:
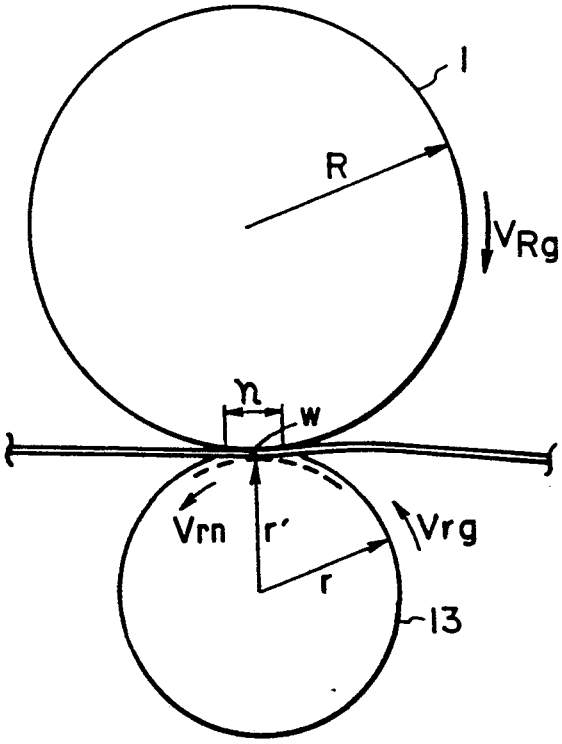
FIGS. 2A and 2B are side views of an image bearing member and transfer means usable with an image forming apparatus according to the present invention.

Referring to FIG. 2A in this embodiment, the peripheral speed Vrn of the roller 13 is higher than the peripheral speed VRg of the photosensitive member 1 at the contact portion w (transfer position). This is done by controlling the peripheral speed Vrg determined by the outside diameter of the roller 13 when the roller is not contacted to the photosensitive member.

Figure 2B:
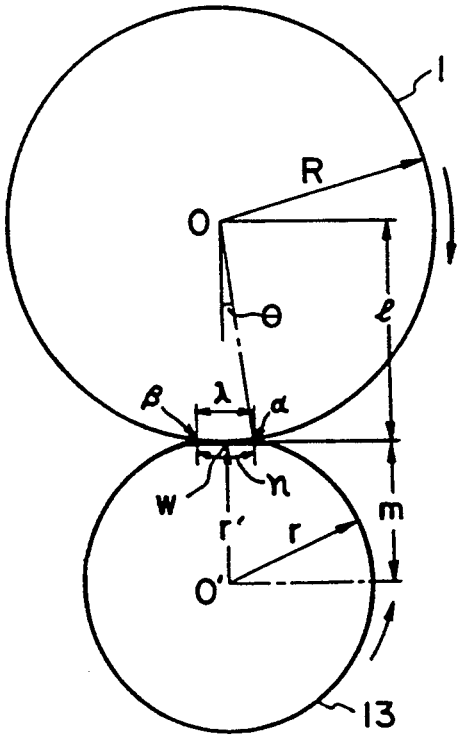

Referring to FIG. 2B, the calculation for the peripheral speeds Vrn and Vrg will be described.

It is assumed that R is a radius of the photosensitive member 1 (mm), r is a radius of the roller 13 (mm), $\eta$ is a width of the contact portion w (mm), r' is a radius of the roller 13 at the central point of the contact portion where it is deformed by the press-contact, $\lambda$ is a length of cord $\alpha\beta$ formed by the photosensitive member 1 and the roller 13 (mm), l and m are distances from the cord $\alpha\beta$ to the center O of the photosensitive member 1 and the center O' of the roller 13, and $\theta$ is an angle as seen from the center O of the photosensitive member 1 between the inlet $\alpha$ and the central point of the contact portion w. Then, $$l = R\cos\theta = R\cos(\eta/2R) \quad (1)$$

$$\lambda/2 = R\sin\theta = R\sin(\eta/2R) \quad (2)$$

From equations (1) and (2), $$m = \sqrt{r^2 - (\lambda/2)^2} = \sqrt{r^2 - R^2\sin^2(\eta/2R)} \quad (3)$$

Since, $$r' = l + m - R$$

then, $$r' = R\,\mathrm{con}(\eta/2R) + \sqrt{r^2 - R^2\sin^2(\eta/2R)} - R \quad (4)$$

Therefore, the peripheral speed Vrn at the central point of the contact portion w is $$Vrn = r'/r \times Vrg = 1/r\,[R\cos(\eta/2R) + \sqrt{r^2 - R^2\sin^2(\eta/2R)} - R]Vrg \quad (5)$$

where Vrg is the peripheral speed of the roller 13.

Referring to FIG. 2A, even when the transfer material is present between the photosensitive member 1 and the roller 13, the thickness of the transfer material is negligibly small as compared with the radii of the roller 13 and the photosensitive member 1, and therefore, the peripheral speed of the roller is substantially equal to Vrn.

In the image forming apparatus shown in FIG. 1, the diameter of the photosensitive member was 30 mm, and the diameter of the roller was 20 mm. The roller 13 was driven by the rotational shaft of the photosensitive member 1. The pressure between the photosensitive member 1 and the roller 13 was controlled within the range of 50–200 g/cm$^2$ when the width of the contact area measured in the circumferential direction was 4 mm, and the length in the longitudinal direction was 220 mm. From the standpoint of the good conveying performance for the transfer material P, it is preferably 120–140 g/cm$^2$. The pressure is obtained by dividing the total pressure applied to the transfer roller against the photosensitive member by the urging means 17 divided by the contact area between the photosensitive member and the transfer roller.

If the pressure is less than 50 g/cm$^2$ within the range of the hardness of the transfer roller of 20–40 degrees (Asker C), the gripping force to the transfer material by the nip is not enough, so that the conveying performance is low with the result that the transfer material P is easily influenced by the other rollers such as the registration roller or the fixing roller when it is discharged from or introduced to such a roller. If this occurs, the image is blurred.

If, on the contrary, it exceeds 200 g/cm$^2$, the toner is strongly urged to the photosensitive member with the result of higher liability of the central void occurrence. In addition, the core metal of the transfer roller bends, so that the transfer nip width is different in the longitudinally central portion than in the opposite end portions. More particularly, at the end portions, the nip width is large because of the urging force of the urging means, whereas at the central portion not urged by the urging means, the distance from the photosensitive member is large, so that the nip width is small. As a result, the electric field is not uniform. In addition, the conveying speed for the transfer material is not uniform along the length, and therefore, a proper image can not be provided.

As described in the foregoing, the urging force and the hardness have a close relation from the standpoint of assuring the proper nip. However, they are independently influential to the sheet conveying property and the occurrence of the central void, and therefore, it is preferable that they are proper, respectively.

The process speed which was equal to the peripheral speed Vrg of the photosensitive member 1 was 50 mm/sec.

In the experiments, the peripheral speed Vrn at the central point of the contact width W of the roller 13 was made higher by approximately 2% than the peripheral speed Vrg of the peripheral speed of the photosensitive member 1. The peripheral speed Vrn was $1.02 \times 50 = 51$ (mm/sec) at the central point, the peripheral speed Vrg required to provide the peripheral speed of 51 (mm/sec) was 52.7 (mm/sec) from the above equation (5). Therefore, in the experiments in which the driving force is provided from the rotational shaft of the photosensitive member 1, the above peripheral speed was provided by adjusting the gear ratio between the driving gear (not shown) of the roller 13 and the driving gear (not shown) of the photosensitive member 1.

As described in the foregoing, by making the peripheral speed Vrn of the roller 13 at the central point of the contact width w higher by 2% than the peripheral speed VRg of the photosensitive member 1, there occurred no slippage or deviation between the transfer material P and the photosensitive member 1 during the transfer operation, and the transfer operation could be performed substantially at the same peripheral speeds. Thus, the significant problem of the central void in the image transfer on the OHP sheet (made of polyethylene terephthalate) has been solved. Therefore, a good image can be formed, irrespective of the ambient condition variations, without image deviation or crease and with stabilized transfer material conveyance.

The reason why the central void can be avoided by making the peripheral speed of the roller 13 higher than the peripheral speed of the photosensitive member 1 is considered as being that the transfer material urged by the roller 13 rubs the toner off the transfer member 1.

Similar experiments have been carried out while the increase of the roller 13 peripheral speed Vrn is changed from 0.5–5% with the increment of 0.5%. It has been confirmed that sufficient effects were provided when the increase is 1–3% when it was lower than 1%, the central void occurred, and if it exceeded 3%, the central void is produced, and in addition, the image was remarkably elongated with the result of the problems of the image accuracy. In the experiments, the diameter and the gear ratio was changed to provide the intended peripheral speed. Another method for accomplishing this includes increasing the roller diameter to increase the peripheral speed, and the photosensitive member and the roller are driven by separate driving sources.

Figure 3:
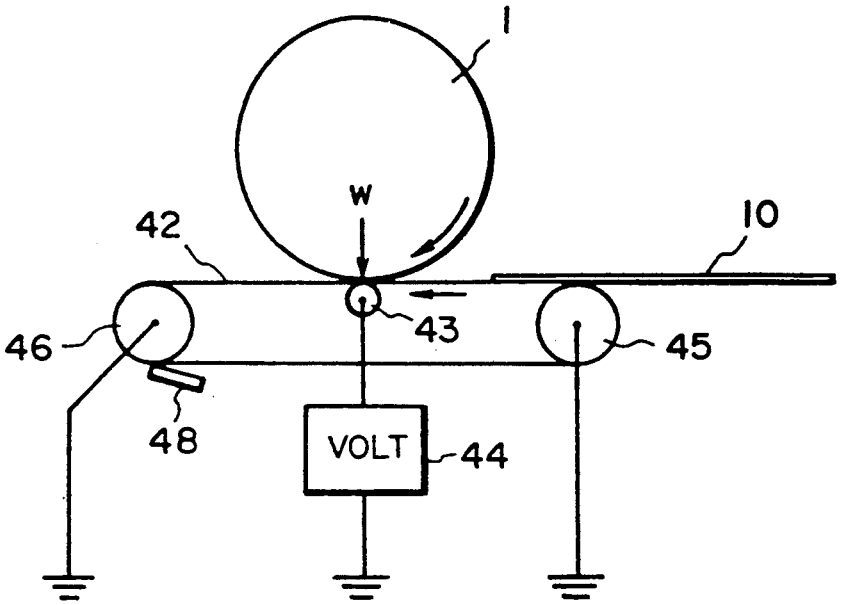
FIG. 3 is a sectional view of an image forming apparatus according to another embodiment of the present invention.

FIG. 3 shows an image forming apparatus according to an embodiment of the present invention, using as the transfer means, a transfer and conveying belt 42 and an electrode roller 43.

The photosensitive member is contacted to a belt 42 trained around a supporting roller 46 and a driving roller 45 driven by an unshown driving means to travel in the direction indicated by an arrow. When the transfer material 10 passes through the transfer position, that is, the nip formed by the contact between the photosensitive member 1 and the belt 42, in timed relation with the visible image on the surface of the photosensitive member to the transfer material 10, the visualized image is transferred from the photosensitive member 1 by the voltage supplied from the source 44 to the roller electrode 43 disposed across the transfer material 10 from the photosensitive member 1. Then, the belt 42 is cleaned by the cleaning blade 48.

The examples of the material of the belt 42 include a semiconductive material of a single layer made of PVdF or PET thermoplastic elastomer, polyolefine thermoplastic elastomer, polyurethane thermoplastic elastomer, polyethylene thermoplastic elastomer, polyamide thermoplastic elastomer, fluorinated thermoplastic elastomer, ethylene vinyl acetate thermoplastic elastomer, polyvinyl chloride elastomer or the like. The electric conductivity thereof is given by a polar group of polychloride vinyl group or the like. The conductivity is given by polar group such as hydroxide group or second amino group, so that it has the volume resistivity of $10^{11}$-$10^{15}$ ohm.cm.

In this embodiment, the material of the transfer belt was urethane thermoplastic elastomer having the volume resistivity of $10^{14}$ ohm.cm and the thickness of 150 microns. The hardness thereof was Shore 50-70 degrees.

In FIG. 3, the photosensitive member 1 has a diameter of 60 mm, and the electrode roller 43 has a diameter of 8 mm and was made of conductive EPDM having a hardness of Asker C 25 degrees. The thickness of the transfer belt is negligibly small as contrasted to the diameter of the electrode roller 43, so that the hardness of the combination of the electrode roller 43 and the transfer belt was the same as the hardness of only the electrode roller.

The belt 42 has a circumferential length of 220 mm, a width of 210 mm, and a nip width of 4 mm with respect to the photosensitive member 1, and the contact pressure was 50-80 g/cm$^2$.

In the experiments, the photosensitive member 1 and the belt 42 were driven by separate driving devices. However, the peripheral speed may be changed on the basis of the gear ratio similarly to the foregoing embodiment.

In the apparatus shown in FIG. 3, the peripheral speed difference between the photosensitive member 1 and the transfer belt contacted to the electrode roller 42 was changed from 0.5%-5% in increments of 0.5%. The results showed that the central void can be effectively avoided when it was 1-3%, similarly to the case of the roller. If it exceeds 3%, the transfer material 10 is not stably conveyed because of the relation between the curvatures of and the press-contact pressure between the photosensitive member 1 and the belt 42 with the result of frequent deviation in the image transfer. If it is lower than 1%, or higher than 3%, the central void was not prevented, in this embodiment.

Figure 4:
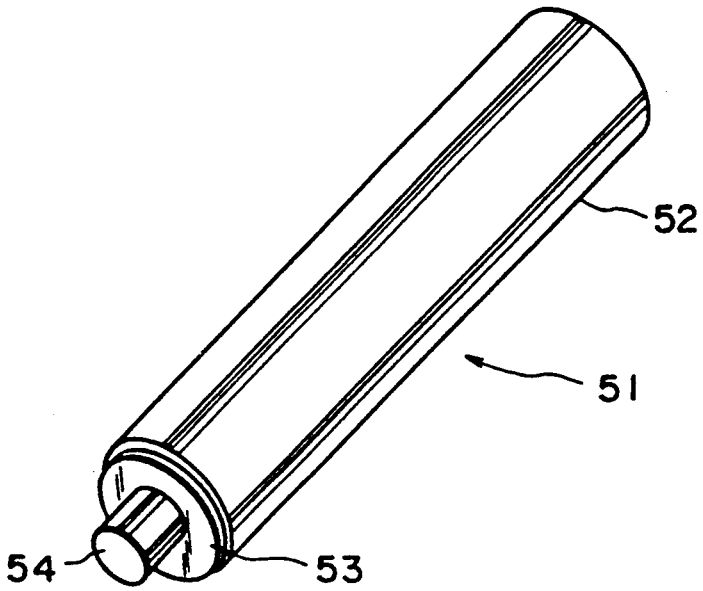
FIG. 4 is a perspective view of an image transfer roller usable with an image forming apparatus according to the present invention.
Figure 5A:
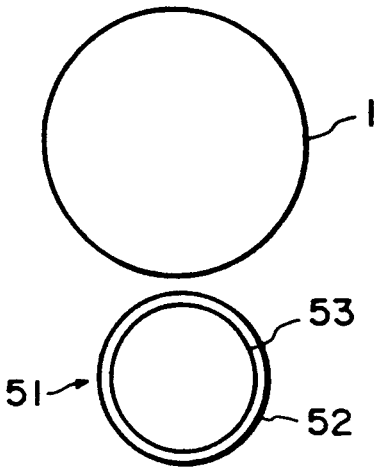
FIGS. 5A and 5B are sectional views illustrating the positional relationship between the transfer roller and the image bearing member of FIG. 4.
Figure 5B:
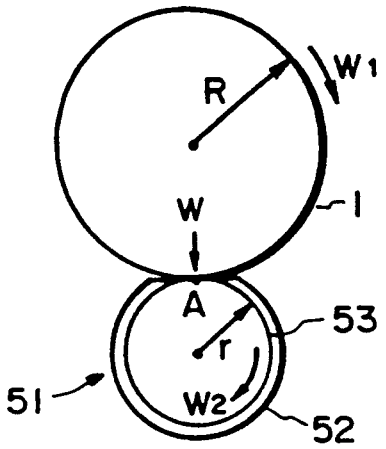
Figure 6:
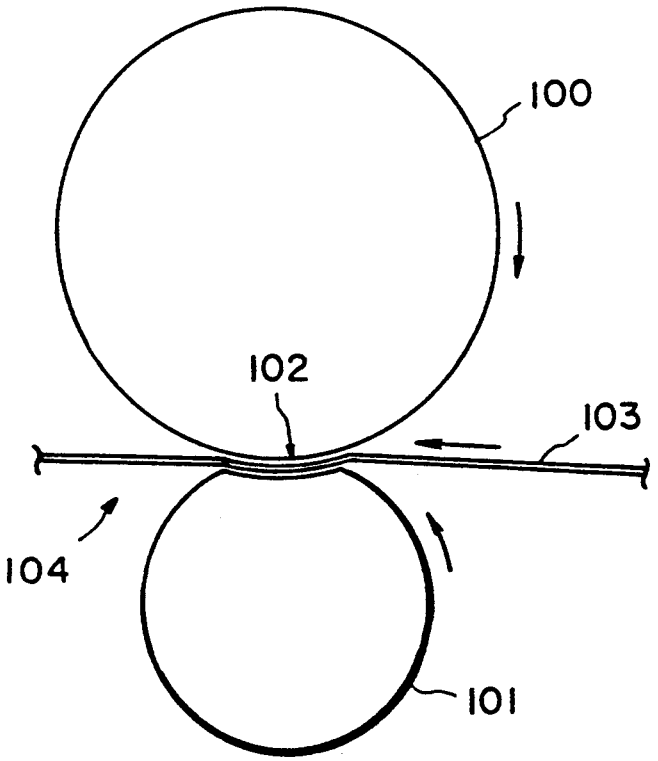
FIG. 6 PRIOR ART
FIG. 6 is a sectional view of a conventional image transfer device.
Figure 7A:
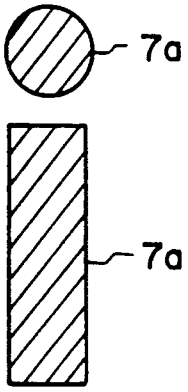
FIGS. 7A and 7B illustrate properly transferred image and an improper transferred image with central void.
Figure 7B:
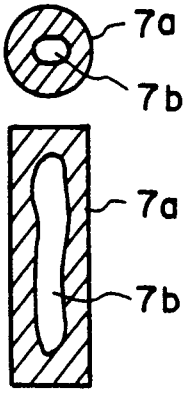

Referring to FIGS. 4, 5A and 5B, the description will be made as to another embodiment wherein abutting members 53 for abutment to the photosensitive member 1 are provided at the longitudinal ends of the roller 51 (transfer means). The abutting member 53 made of rigid material and a transfer member 52 having the elasticity are bonded on the core metal 54.

In this embodiment, the distance between the photosensitive member 1 and the roller 51 is made constant. FIGS. 5A and 5B show the states in which the photosensitive member 1 and the roller 51 are not contacted. The transfer member 52 is made of foaming rubber or the like and is depressed by the contact with the photosensitive member 1 until the photosensitive member 1 contacts the rigid abutting member 53 at the position A.

The amount of depression of the transfer member 52 when the photosensitive member 1 comes to the position A, can be changed by changing the radius of the abutting member 53. The same is possible also by changing the thickness of the transfer member 52 with a constant radius r of the abutting member 53.

The peripheral speed at the point A is, in this embodiment, Rw1 and rw2, respectively. The peripheral speed rw2 is higher than Rw1 by 1-3%.

The roller 51 is used in the image forming apparatus of FIG. 1. The photosensitive member 1 has a diameter of 30 mm, and the roller 51 has a diameter of 20 mm and is made of foaming EPDM rubber having Asker C hardness of 28 degrees. The diameter of the abutting member 53 is 9.7 mm (r) from equation (4) to provide the contact width of 4 mm. The pressure between the photosensitive member 1 and the roller 51 was 50-60 g/cm$^2$. The contact pressure can be adjusted by adjusting the spring 17 for urging the core metal of the roller 51.

In this embodiment, the roller and the photosensitive member 1 are driven separately. The peripheral speed is changed from 0.5-5% with the increment of 0.5%. The transfer material 10 was OHP sheet. It has been confirmed that the central void can be most effectively avoided when the peripheral speed of the roller 51 is higher than that of the photosensitive member 1 by 1-3%. If it is lower than 1% or higher than 3%, the central void preventing effect is not enough, in this embodiment. In these experiments, the nip can be stably provided at all times, and therefore, even if the driving force is provided from the rotational shaft of the photosensitive member 1, the peripheral speed at the central position of the nip (contact portion) can be assuredly controlled, so that good transfer property can be maintained at all times.

Thus, the central void can be prevented by driving the transfer member at the transfer position at a peripheral speed higher than the peripheral speed of the photosensitive drum 1. The reason for this is considered as follows. When the transfer material is the OHP sheet, the friction coefficiency of the surface of the OHP sheet is so small that a slippage occurs between the OHP sheet and the photosensitive drum 1 with the result that the conveyance speed of the transfer material at the nip n is substantially lower than the periphery of the photosensitive drum 1. That is, the movement speed of the visualized image 7 thereon. This is why the central void can occur. On the basis of this finding, the transfer member such as the transfer roller is moved at a higher speed to promote the movement of the transfer material to prevent the slippage, and therefore, to prevent the central void in the embodiments.

Figure 8:
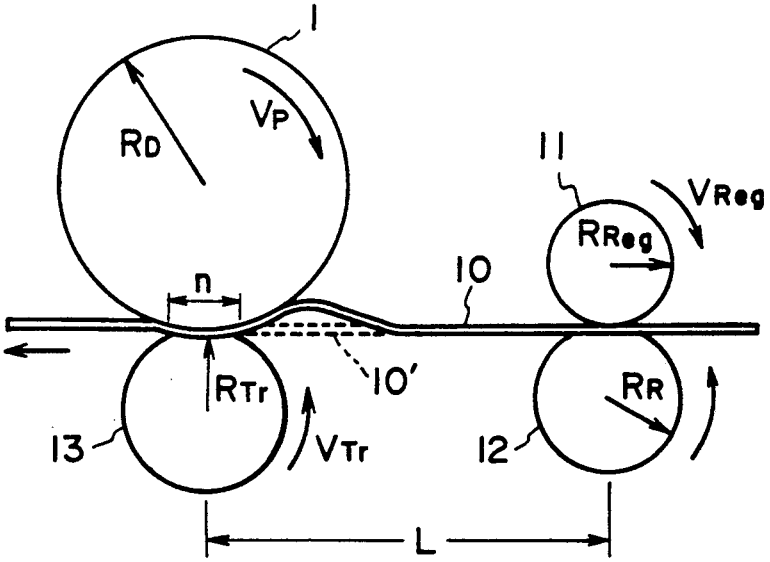
FIG. 8 is a sectional view of an image forming apparatus according to another embodiment of the present invention.

It has further been found that when the transfer material 10 is plain paper without changing the above-conditions of the peripheral speeds, the movement speed of the transfer material in the transfer nip n is too high, since the frictional coefficient of the surface of the plain paper is larger than that of the OHP sheet, and the central void occurs to the contrary. Referring to FIG. 8, a further embodiment will be described in which the central void can be avoided irrespective of whether the transfer material (second image bearing member) is OHP sheet or plain paper.

Similarly to the FIG. 1 image forming apparatus, the image forming apparatus of this embodiment comprises a photosensitive drum (first image bearing member) 1, an image transfer roller (transfer member) 13 and a pair of registration rollers (conveying means) 11 and 12. The transfer material is designated by a reference numeral 10. In this embodiment, the pair of registration rollers 11 and 12 constitute the final conveying means in the passage of the transfer material 10 toward the photosensitive drum 1. The registration rollers, as shown in FIG. 8, grip and convey the transfer material while a part of the transfer material 10 is being caught by the transfer nip at the transfer position.

It is assumed that Vp is the peripheral speed of the photosensitive drum; VTr is the peripheral speed of the transfer roller 13 at the transfer position; VReg is the peripheral speed of the registration roller 11; RD is a radius of the photosensitive drum 1; RTr is a radius of the transfer roller 13 at the transfer position; and RReg is a radius of the registration roller 11. Then, $$Vp = RD \times wD \quad (1)$$

$$VTr = RTr \times wTr \quad (2)$$

$$VReg = RReg \times wReg \quad (3)$$

where the wD is a rotational speed of the photosensitive drum; wTr is the rotational speed of the transfer roller 13; and wReg is the rotational speed of the registration roller 11.

In this embodiment, Vp<VTr is satisfied, by which the central void can be avoided both when the transfer material 10 has the surface frictional coefficient as in the OHP sheet made of polyethylene terephthalate and when the transfer material 10 has a large surface frictional coefficient as in the plain paper. In the latter case, even if the transfer material 10 is pulled by the transfer rcller 10 satisfying Vp<VTr, the transfer sheet 10 is prevented to be stretched between the registration rollers 11 and 12 and the transfer nip n (broken lines 10' in FIG. 8). By satisfying Vp<VReg the transfer material 10 is contacted to the surface of the photosensitive drum 1 before it is introduced into the transfer nip n, so that the central void can be prevented.

Table 1 shows the occurrences of the central void when the peripheral speed VTr of the transfer roller 13 and the peripheral speed VReg of the registration roller 11 are changed from 98–104% of the peripheral speed of the peripheral speed Vp of the photosensitive drum 1.

TABLE 1

| | Vreg/Vp | | | |
|---|---|---|---|---|
| VTr/Vp | 0.98 | 1.00 | 1.02 | 1.04 |
| 0.98 | N | N | N | N |
| 1.00 | N | F | F | F |
| 1.02 | N | F | G | G |

TABLE 1-continued

| | Vreg/Vp | | | |
|---|---|---|---|---|
| VTr/Vp | 0.98 | 1.00 | 1.02 | 1.04 |
| 1.04 | N | F | G | G |

N: The central void occurs for OHP sheet and for plain paper.
F: The central void occurs for OHP sheet or plain paper.
G: The central void does not occur for either of the OHP sheet and the plain paper.

The peripheral speeds of the photosensitive drum 1, the transfer roller 13 and the registration roller 11 are determined by the respective radii and the respective rotational speed (angular speed), and therefore, they are properly selected to avoid the central void by one skilled in the art.

Often, the photosensitive drum 1, the transfer roller 13 and the registration roller 11 are coupled with a gear and driven by the same driving source, and the angular speeds wD, wTr and wReg are determined by the gear couplings. On the basis of the radius RD of the photosensitive drum 1, the radii RTr and RReg of the transfer roller 13 and the registration roller 13 are determined to satisfy the above relationships. It is a possible alternative that one or more of the photosensitive drum 1, the transfer roller 13 and the registration rollers 11 and 12 ar independently driven, so that the peripheral speeds Vp, VTr and VReg satisfy Vp<VTr and Vp<VReg.

If the peripheral speed VTr of the transfer roller 13 is too high as compared with the peripheral speed Vp of the photosensitive drum 1, the OHP sheet is moved at a too high speed with the possible result of the image transfer deviation or the like as well as the central void. Empirically, it has been confirmed that if VTr/Vp is 1.01–1.10, neither of the central void and the transfer deviation occurs when the transfer material 1 an OHP sheet made of polyethylene terephthalate.

If the peripheral speed VReg of the registration roller 13 is too much higher than the peripheral speed Vp of the photosensitive drum 1, the shock occurring at the time when the trailing edge of the transfer material 10 is released from the pair of the registration rollers 11 and 12, is transmitted to the transfer nip with the result of image disturbance. This does not easily occur when a distance L between the transfer nip n and the nip of the registration rollers 11 and 12 is large. In addition, it does not easily occur when the level of the nip of the registration rollers 11 and 12 is higher than the transfer nip n. When, however, they are at the same height levels as shown in FIG. 8, neither of the central void and the image disturbance occurs if the ratio VReg/Vp is 1.01–1.05. This has been empirically confirmed.

Thus, the central void can be prevented for the OHP sheet and the plain paper by driving the transfer roller 13 at a peripheral speed larger than that of the transfer drum 1 at the transfer position and by feeding the transfer material 10 by the registration rollers 11 and 12 at the speed higher than the peripheral speed of the photosensitive drum 1.

The possible problem resulting from the above peripheral speed difference, that is, the elongation of the final image on the transfer drum, will be dealt with. This problem can be avoided by the magnification of the visualized image 7 on the photosensitive drum 1 on the circumferential direction of the photosensitive drum 1 is made smaller than 1.0 (one-to-one), by which the magnification of the image on the transfer material 10 in the detection of the travel of the transfer material 10 can be made substantially 1.0 (one-to-one).

Referring back to FIG. 1, the embodiment of this type will be described.

The photosensitive drum 1 includes an aluminum cylinder coated with an organic photoconductor (OPC). It has an outside diameter of 30.0 mm. It is driven at a speed of one full turn per sec, and therefore, the peripheral speed is 94.2 mm/sec. The primary charger 2 charges the photosensitive drum 1 to −600 V dark portion potential (VD). The laser 3 is projected to provide the light portion potential (VL) of −100 V. The developing device 6 effects the reverse development to deposit the toner having a volume average particle size of 6 microns onto the light portion to provide a visualized image 7.

The transfer roller 13 is driven by the shaft of the photosensitive drum 1 through the gear couplings, and the gear ratio is such that the photosensitive drum has 30 teeth, and the transfer roller has 20 teeth. When RTr=10 mm, VTr=Vp=94.2 mm/sec. In this embodiment, the transfer roller is an intermediate resistance roller comprising as base material EPDM, having a resistivity of $10^8$ ohm. The hardness of the transfer roller 13 was 30 degrees (Asker C), and the width of the transfer nip n is 3.0 mm. The pressure between the transfer roller and the photosensitive drum 1 is 200 g/cm$^2$.

The registration roller 11 is made of stainless steel and is driven through a clutch by the shaft of the photosensitive drum 1. The gear ratio is such that the photosensitive drum has 30 teeth, and the registration roller has 14 teeth. When RReg is 7.0 mm, VReg=Vp=94.2 mn/sec.

In this embodiment, $$RReg=7.1\ mm.$$

The registration roller 12 includes a core metal and a rubber layer made of chloroprene having a hardness of 60 degrees (Asker C), the gear ratio between the registration roller 11 is 1:1. In this embodiment, the radius of the registration roller 12 is 8.2 mm (R12).

The distance L between the transfer nip n and the pair of registration rollers 11 and 12 is 50 mm, and the height level of the transfer nip n is substantially equal to that of the nip of the registration rollers 11 and 12.

In this embodiment, $$VTr/Vp=1.05,\ and\ VReg/Vp=1.01.$$

The transfer materials 10 used are an OHP sheet having a thickness of 100 microns made of polyethylene terephthalate as a base and a plain paper sheet having the basis weight of 64–105 g/m$^2$.

Under the above conditions, one sided prints and two-sided prints were produced from high to low humidity conditions, and it has been confirmed that the central void occurs. In addition, the central void is not produced even when a thin sheet, a thick sheet such as post card, and an envelope are used.

As described in the foregoing, the central void can be avoided by making VReg/Vp and VTr/Vp larger than 1.00. When, however, the rigidity of the transfer material 10 is large, the magnification of the transferred image in the direction of the rotation of the photosensitive drum 1 becomes larger than 1.0 which is the magnification in the perpendicular direction, that is, the image is elongated.

This is remarkable when the paper vein is codirectional with the travel of the transfer sheet. When, for example, an A4 size sheet having a length of 197 mm in the traveling direction, is used, the elongation at the trailing edge may be as large as 2 mm.

In this embodiment, the possible image elongation when the ratios VReg/Vp and VTr/Vp are larger than 1.0, can be prevented. The magnification of the visualized image 7 in the circumferential direction on the photosensitive drum 1 is made smaller than 1.00, to compensate the image elongation on the transfer material 10. To accomplish this, the pitch of the laser beam scanning onto the photosensitive drum is reduced. Examples will be described.

(a) Increasing the Rotational Speed of the Polygonal Mirror 4

The rotational speed R (rpm) of the polygonal mirror 4 is $$R=(60/25.4)\times Vp\times(D/N) \quad (4)$$

where D is the scanning resolution (dpi: dots per inch), Vp is the peripheral speed of the photosensitive drum 1 or the process speed; N is the number of surfaces of the polygonal mirror 4.

When the polygonal mirror 4 is rotated at the speed R, the magnification of the visualized image 7 on the photosensitive drum 1 in the circumferential direction is 1.00. If the rotational speed of the polygonal mirror 4 is 0.993R, the circumferential magnification of the visualized image 7 is 0.993. Then, in the case of the longitudinally fed A4 size sheet, that is, the long side is parallel with the feeding direction, the image from the leading edge of the trailing edge reduces by $$297\times(1-0.993)=2\ (mm).$$

That is, the visualized image 7 is so reduced. The magnification in the longitudinal direction of the photosensitive drum 1 is $$1/0.993=1.007$$

Therefore, the image is elongated in that direction. It is preferable that the on-time of the laser 3 per one picture element is made 0.993 time the usual time, in other words, the image clock is multiplied by 1.007, so that the elongation in this direction is compensated.

(b) Reducing the Rotational Speed Vp of the Photosensitive Drum 1

The reduction of the circumferential magnification of the visualized image 7 can be provided by reducing the photosensitive drum speed Vp relative to the rotational speed R of the polygonal mirror. More particularly, the process speed (FIG. 8) is 0.993 Vp. By doing so, the circumferential magnification of the visualized image 7 is multiplied by 0.993.

As for the method of reducing the rotational speed Vp of the photosensitive drum 1, the above-equation (1) gives (A) reducing the angular speed wD of the photosensitive drum 1, or (B) reducing the radius RD of the photosensitive drum 1.

At this time, $$VTr/Vp=(RTr/RD)\times(wTr/wD),\ \text{and}$$

$$VReg/Vp=(RReg/RD)\times(wReg/wD)$$

are within the range above 1.00 as described in the foregoing embodiments. When the photosensitive drum 1, the transfer roller 13 and the registration roller 11 are driven through the gear couplings, the ratio wReg/wD is constant. Therefore, when the rotational speed wD of the photosensitive drum 1 is reduced as in (A), wTr and wReg are correspondingly reduced. The radius RTr of the transfer roller 13 and the radius RReg of the registration roller 11 are the same as in the embodiment of FIG. 8.

On the other hand, the radius RD of the photosensitive drum 1 is reduced as in (B) to reduce the speed Vp, will be dealt with. When the photosensitive drum 1, the transfer roller 13 and the registration roller 11 are driven through gear couplings, the radius RTr of the transfer roller 13 and the radius RReg of the registration roller 11 can be reduced correspondingly to the reduction of RD. As a result, the radius RTr of the transfer roller 13 and the radius RReg of the registration roller 11 in the foregoing embodiment are usable.

In the embodiment of FIG. 8, $wD=2\pi$ (rad/sec). In an example of reducing the rotational speed wD of the photosensitive drum 1 (A), $$wD=2\pi\times0.993=1.986\pi(rad/sec)$$

In an example of reducing the radius RD of the photosensitive drum 1 (B), referring to the embodiment of FIG. 8, $$RD=30.0\times0.993=29.8\ (mm)$$

$$RTr=10.0\ (mm)$$

$$RReg=7.0\ (mm)$$

$$R12\ (radius\ of\ the\ registration\ roller\ 12)=8.0\ (mm)$$

The others are the same as in FIG. 8 embodiment.

In the above described method, the longitudinal direction magnification of the photosensitive drum 1 is 1.00, since the rotational speed of the polygonal mirror R is as given by equation (4). And therefore, the image clock is as usual.

In the foregoing description, the transfer material 10 is conveyed substantially in a horizontal plane. The present invention is applicable to the case wherein the transfer material 10 is conveyed vertically from the bottom to the top, and the transfer roller 13 is along the conveyance passage.

The transfer member may be in the form of a transfer belt or other rotatable or surface moving member with the same advantageous effects.

The first image bearing member is not limited to the rotatable drum, but may be a rotatable belt or a traveling web or the like.

In the foregoing embodiments, the developer preferably comprises toner particles and fine particles treated with silicone oil or silicone varnish. The fine particles are effective to enhance the toner parting property from the image bearing member during the image transfer operation, so that the central void can be further prevented.

In order to provide the high resolution image, it is preferable that the toner has a volume average particle size of not more than 8 microns, preferably. However, the toner agglomeration is enhanced, so that the central void is promoted, and therefore, the present invention is particularly effective.

As described, according to the present invention, the hardness of the transfer member is 20–40 degrees (Asker C); the contact pressure between the transfer member and the image bearing member is 50–200 g/cm$^2$; the peripheral speed of the transfer means at the transfer position during the transfer operation is larger than the peripheral speed of the image bearing member at the transfer position, by which the central void can be avoided when the transfer material is OHP sheet, and in addition, the sliding and the image deviation between the transfer material and the image bearing member upon the transfer operation can be avoided.

According to another aspect of the present invention, a first peripheral speed of the transfer means at the transfer position during the image transfer operation is made larger than a second peripheral speed of the image bearing member at the transfer position; and the conveying speed of the transfer material to the transfer position is made larger than the second peripheral speed. Therefore, the central void can be avoided for the transfer material such as a thin sheet, a thick sheet such as post card, an envelope or an OHP sheet, irrespective of the ambient condition changes.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

image forming means for forming a toner image on said image bearing member; and transfer means contactable to said image bearing member at a transfer position, said transfer means transferring the toner image formed by said image forming means onto a transfer material while the transfer material is conveyed through the transfer position together with said image bearing member;

wherein said transfer means has a hardness of 20–40 degrees (Asker-C), and it is pressed to said image bearing member at a pressure of 50–200 g/cm$^2$, and wherein a peripheral speed of said transfer means at the transfer position during a transfer operation is higher than a peripheral speed of said image bearing member at the transfer position.

2. An apparatus according to claim 1, wherein said transfer means includes a rotatable member.

3. An apparatus according to claim 2, wherein said transfer means is in the form of a roller.

4. An apparatus according to claim 2, wherein said transfer means includes a belt-like member contactable to said image bearing member and a roller contacted to said belt-like member at an opposite side.

5. An apparatus according to claim 1, wherein said transfer means is elastic.

6. An apparatus according to claim 5, wherein said transfer means has a layer comprising EPDM.

7. An apparatus according to claim 1, wherein said transfer means is supplied with a voltage in an image transfer operation.

8. An apparatus according to claim 1, wherein said image forming means includes developing means for developing said image bearing member with a developer.

9. An apparatus according to claim 8, wherein said developing means uses a developer having toner particles and particles treated with silicone oil or silicone varnish.

10. An apparatus according to claim 1, wherein said image bearing member comprises an organic photoconductive material.

11. An apparatus according to claim 1, wherein said transfer means has a peripheral speed which is larger than that of said image bearing member by 1.0–3.0%.

12. An apparatus according to claim 5, wherein said transfer means includes a sponge layer.

13. An apparatus according to claim 1, wherein a magnification of the latent image formed on said image bearing member by said image forming means in a direction of movement of a periphery of said image bearing member is smaller than 1.0.

14. An apparatus according to claim 1, wherein the transfer material is a resin sheet.

15. An image forming apparatus, comprising:

a movable image bearing member;

image forming means for forming a toner image on said image bearing member;

transfer means for transferring the toner image formed by said image forming means onto a transfer material at a transfer position, while the transfer material is conveyed through the transfer position with said image bearing member; and conveying means for conveying the transfer material to the transfer position while a part of the transfer material is present at the transfer position;

wherein a peripheral speed of said transfer means at the transfer position during an image transfer operation is larger than a peripheral speed of said image bearing member at the transfer position, and wherein a conveying speed by said conveying means is higher than the peripheral speed of said image bearing member.

16. An apparatus according to claim 15, wherein said transfer means includes a rotatable member.

17. An apparatus according to claim 16, wherein said transfer means is in the form of a roller.

18. An apparatus according to claim 16, wherein said transfer means includes a belt-like member contactable to said image bearing member and a roller contacted to said belt-like member at an opposite side.

19. An apparatus according to claim 15, wherein said transfer means is elastic.

20. An apparatus according claim 19, wherein said transfer means has a layer comprising EPDM.

21. An apparatus according to claim 15, wherein said transfer means is supplied with a voltage in an image transfer operation.

22. An apparatus according to claim 15, wherein said image forming means includes developing means for developing a latent image on said image bearing member with a developer.

23. An apparatus according to claim 22, wherein said developing means uses a developer having toner particles and particles treated with silicone oil or silicone varnish.

24. An apparatus according to claim 15, wherein said image bearing member comprises an organic photoconductive material.

25. An apparatus according to claim 15, wherein said transfer means has a peripheral speed which is larger than that of said image bearing member by 1.0–3.0%.

26. An apparatus according to claim 19, wherein said transfer means includes a sponge layer.

27. An apparatus according to claim 16, wherein a magnification of the latent image formed on said image bearing member by said image forming means in a direction of movement of a periphery of said image bearing member is smaller than 1.0.

28. An apparatus according to claim 15, wherein the transfer material is a resin sheet.

29. An apparatus according to claim 15, wherein the transfer material is plain paper having basis weight of 64–105 $g/m^2$.

30. An apparatus according to claim 15, wherein the conveying speed is 1.01–1.10 times the peripheral speed of said image bearing member.

* * * * *

UNITED STATES PATENT AND TRADEMARK OFFICE

CERTIFICATE OF CORRECTION

PATENT NO. : 5,159,393

DATED : October 27, 1992

INVENTOR(S) : KOICHI HIROSHIMA, ET AL.

It is certified that error appears in the above-identified patent and that said Letters Patent is hereby corrected as shown below:

On title page, item
[56] REFERENCES CITED

U.S. PATENT DOCUMENTS
"Osaki et al." should read --Ozaki et al.--.

COLUMN 3
Line 25, "dot" should read --dots--.

COLUMN 10
Line 35, "1 an" should read --1 is an--.

Signed and Sealed this

Sixteenth Day of November, 1993

Bruce Lehman

*Attest:*

BRUCE LEHMAN

*Attesting Officer*

*Commissioner of Patents and Trademarks*